US005449079A

United States Patent [19]

Yang

[11] Patent Number: 5,449,079

[45] Date of Patent: Sep. 12, 1995

[54] SEALED VACUUM CONTAINER SYSTEM

[76] Inventor: Heng-Te Yang, 20-1 Hsin Ho Heng Rd., Tainan, Taiwan

[21] Appl. No.: 123,684

[22] Filed: Sep. 20, 1993

[51] Int. Cl.[6] ..... B65D 51/16; B65D 55/00

[52] U.S. Cl. ..... 215/228; 215/262; 220/231; 141/65

[58] Field of Search ..... 215/228, 260, 262, 311; 220/209, 212, 231; 141/65

[56] References Cited

U.S. PATENT DOCUMENTS

| | | | |
|---|---|---|---|
| 4,016,999 | 4/1977 | Denzer | 220/231 |
| 4,249,583 | 2/1981 | Lundbladh | 141/65 |
| 4,278,114 | 7/1981 | Ruberg | 141/65 |
| 4,428,478 | 1/1984 | Hoffman | 206/315.9 |
| 4,524,877 | 6/1985 | Saxby et al. | 215/228 |
| 4,763,802 | 8/1988 | Johnston | 215/228 |
| 4,763,803 | 8/1988 | Schneider | 215/260 |
| 4,889,250 | 12/1989 | Beyer | 215/228 |
| 4,989,745 | 2/1991 | Schneider | 220/208 |
| 5,010,928 | 4/1991 | Ballas | 141/64 |
| 5,031,785 | 7/1991 | Lemme | 215/228 |
| 5,347,918 | 9/1994 | Chen | 99/472 |

*Primary Examiner*—Allan N. Shoap
*Assistant Examiner*—Vanessa Caretto

[57] ABSTRACT

A sealed can possible to be pumped vacuum comprising a can body, a cap unit and a vacuum pump, the cap unit being capped on the can body, the vacuum pump being placed on the cap unit to pump out the air in the can body so that the can body becomes vacuum and sealed tightly by the can unit to preserve food kept therein good and fresh for a long period time.

1 Claim, 7 Drawing Sheets

SEALED VACUUM CONTAINER SYSTEM

BACKGROUND OF THE INVENTION

Nowadays, containers for preserving food generally have a container and a cap capped on the container. Though food kept in the container is preserved by the cap, but some air is also kept in the container when the cap is capped on, in spite of open air impossible to flow into the container, prevented by the cap. So the food in the container can gradually be deteriorated in its quality by the air remained therein after a long period of time.

SUMMARY OF THE INVENTION

The present invention has been devised to offer a kind of a sealed can for preserving food possible to be pumped vacuum so that the food kept therein can be preserved with its quality good and fresh for a long period of time.

A sealed can possible to be pumped vacuum in the present invention comprises a can body, a cap unit, and a vacuum pump.

The cap unit has a sealing cap body, an annular gasket, a small bottom cap, an air valve and a small upper cap combined together.

The sealing cap body has a central recess, a central hole, several air holes spaced around the central hole, an annular engaging wall extending down from the bottom of the recess, an outer circumferential edge, two annular walls extending down and defining an annular groove for the annular gasket to fit therein.

The small bottom cap fits around the annular engaging wall of the sealing can body, having two air holes for air to flow through into the interior of the can body.

The annular gasket fits in the annular groove of the sealing cap body to prevent air from passing through after the cap unit is capped on the can body.

The air valve is put in the recess of the sealing cap body, having a round projection extending down to fit in the central hole of the sealing cap body and two inclined projections extending up.

The small upper cap is capped on the air valve, having a sloping-down outer circumferential edge to fit around the recess of the sealing cap body and two opposite slots for the two sloping projections to protrude through upward.

The vacuum pump is to be placed on the cap unit when the can body is to be pumped out of its air, having a cylinder, a pull cylinder, an annular gasket, an annular socket and a handle combined together. The cylinder has a passageway for the pull cylinder to fit and move up and down therein and a stop annular edge on the upper end to stop the pulling cylinder from going further up pumping out the air in the can body. The gasket is fitted around an annular groove in the lower end of the pull cylinder to prevent air from flow through while moving in the cylinder. The handle is capped on the upper end of the pull cylinder to push up and down the pull cylinder in pumping, and the annular socket is fixed around the bottom end of the cylinder.

When the vacuum pump is placed on the can body for pumping out the air in the can body, the air in the can body can be drawn out through the cap unit, but open air cannot flow into the can body, prevented by the air valve in the sealing cap body because of air pressure difference in the interior of the can body and open air.

DETAILED DESCRIPTION OF THE INVENTION

Figure 1:
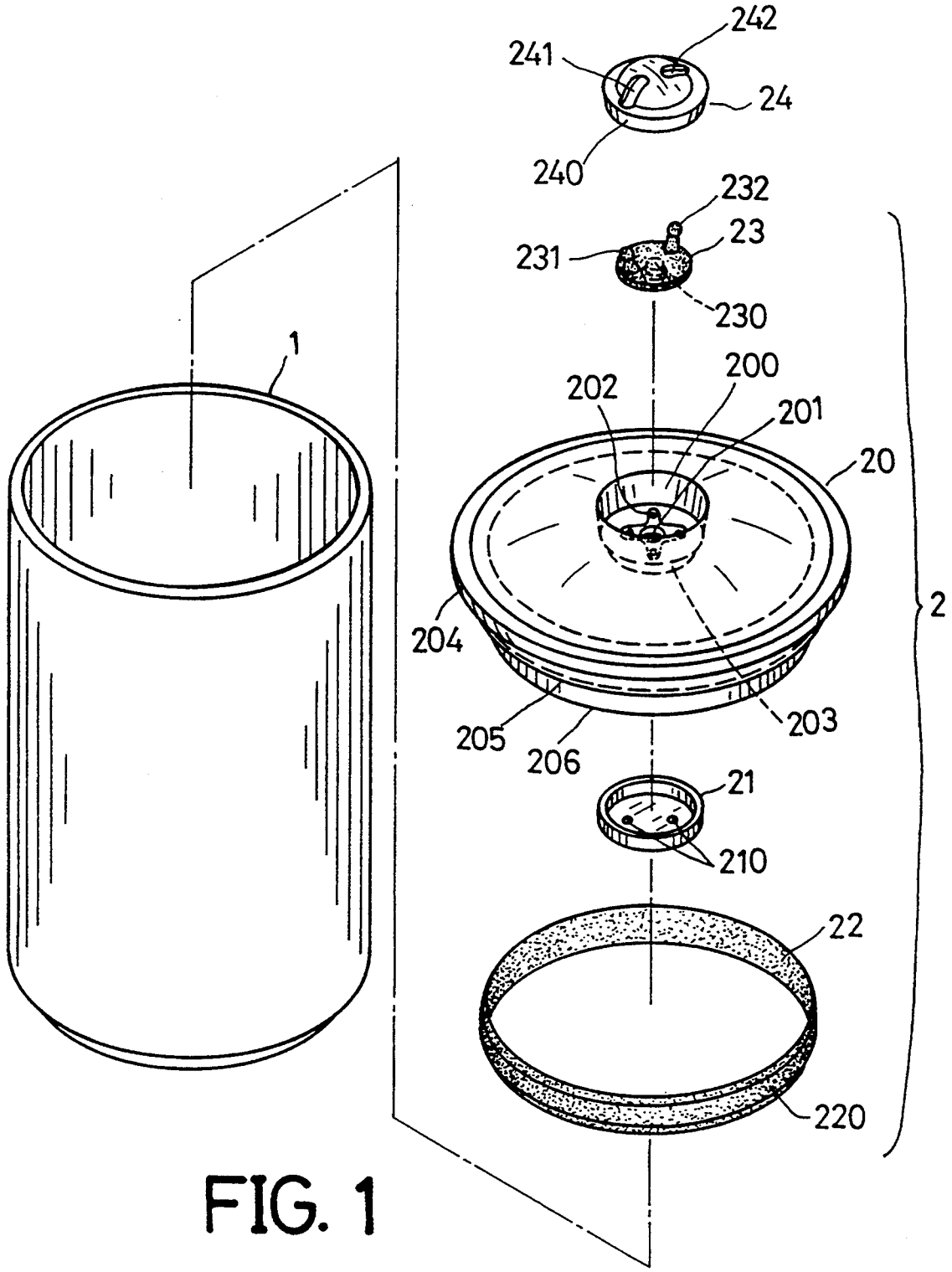
FIG. 1 is an exploded perspective view of a sealed can possible to be pumped vacuum in the present invention.
Figure 2:
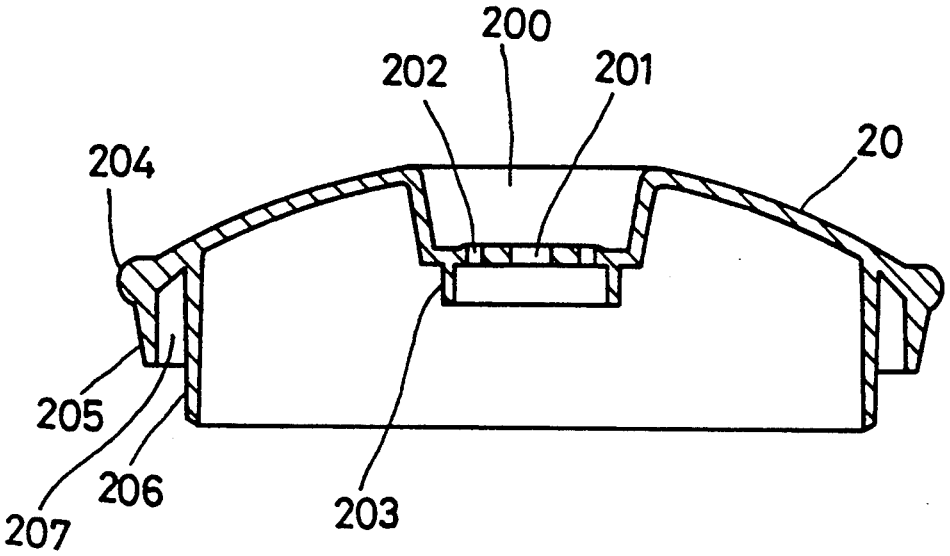
FIG. 2 is a cross-sectional view of a sealing cap body of a cap unit of the seaaled can possible to be pumped vacuum in the present invention.
Figure 3:
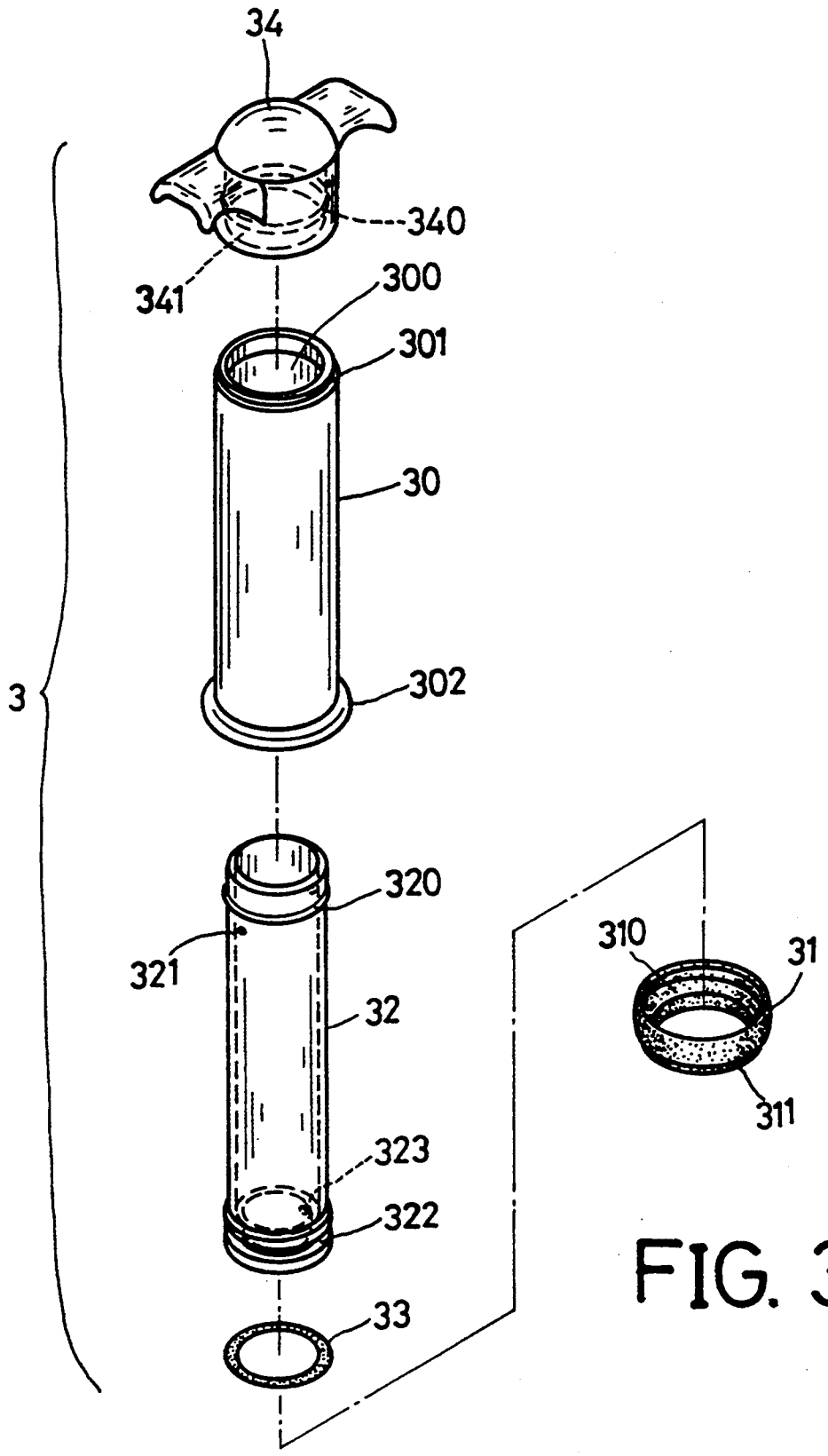
FIG. 3 is an exploded perspective view of a vacuum pump in the present invention.

A sealed can possible to be pumped vacuum in the present invention, as shown in FIGS. 1, 2, 3, comprises a can body 1, a cap unit 2, and a vacuum pump 3 independently provided to pump out the air in the can body 1.

The can body 1 is shaped cylindrical and covered with the cap unit 2.

The cap unit 2 has a sealing cap body 20, a small bottom cap 21 with two air holes 210. 210 fitting around an annular projecting-down wall 203, an annular gasket 22, an air valve 23 and a small upper cap 24 combined together. The sealing cap body 20 has a central recess 200, a central through hole 201 in the central recess 200, four air holes 202 provided spaced apart around the central hole 201, and annular projecting-down wall 203 defining a round hollow space, an outer circumferential curved edge 204, an annular wall 205 projecting down from the outer circumferential edge 204, an annular wall 206 of a smaller diameter than the wall 205 extending down from the lower surface of the cap body 20, an annular groove 207 defined by the two walls 205, 206 as shown in FIG. 2 to receive the annular gasket 22 therein. The annular gasket 22 is made of a soft elastic material, having an annular bulging edge 220 and fitting in the annular groove 207 to prevent aair from passing therethrough.

The air valve 23 is provided to sit in the recess 200 of the sealing cap body 20, made of a soft rubber and having two sloping projections 231, 231, a mushroom-shaped projection 230 extending down from the center to pass through the central hole 201 of the sealing cap body 20.

The small upper cap 24 covers on the air valve 23, having a swelled upper surface, an annular sloping-down surface 240 and two opposite slots 241, 242 for the two projections 231, 231 of the air valve 23 to passing through upward.

The air vacuum pump 3 shown in FIG. 3, comprises a cylinder 30, an annular socket 31, a pulling cylinder 32, an annular gasket 33 and a handle 34 combined together. The cylinder 30 has a central passageway 300, a stop edge 301 at the top of the cylinder 30, a flange 302 at the bottom to engage the annular socket 31, which has an inner annular groove 310, an engaging edge 311 at bottom. The pull cylinder 32 fits in the passageway 300 of the cylinder 30. The pull cylinder 32 has an annular projection 320, an air exit hole 321 below the annular projection 320, an annular groove 322 in the bottom for the gasket 33 to engage with, two opposite air inlet holes 323, 323 in the annular groove 322. The handle 34 is provided to fit around the top of the pull cylinder 32, having two curved plates extending from two opposite sides, an inner annular groove 340 and a sloping edge 341 under the groove 340.

Figure 4:
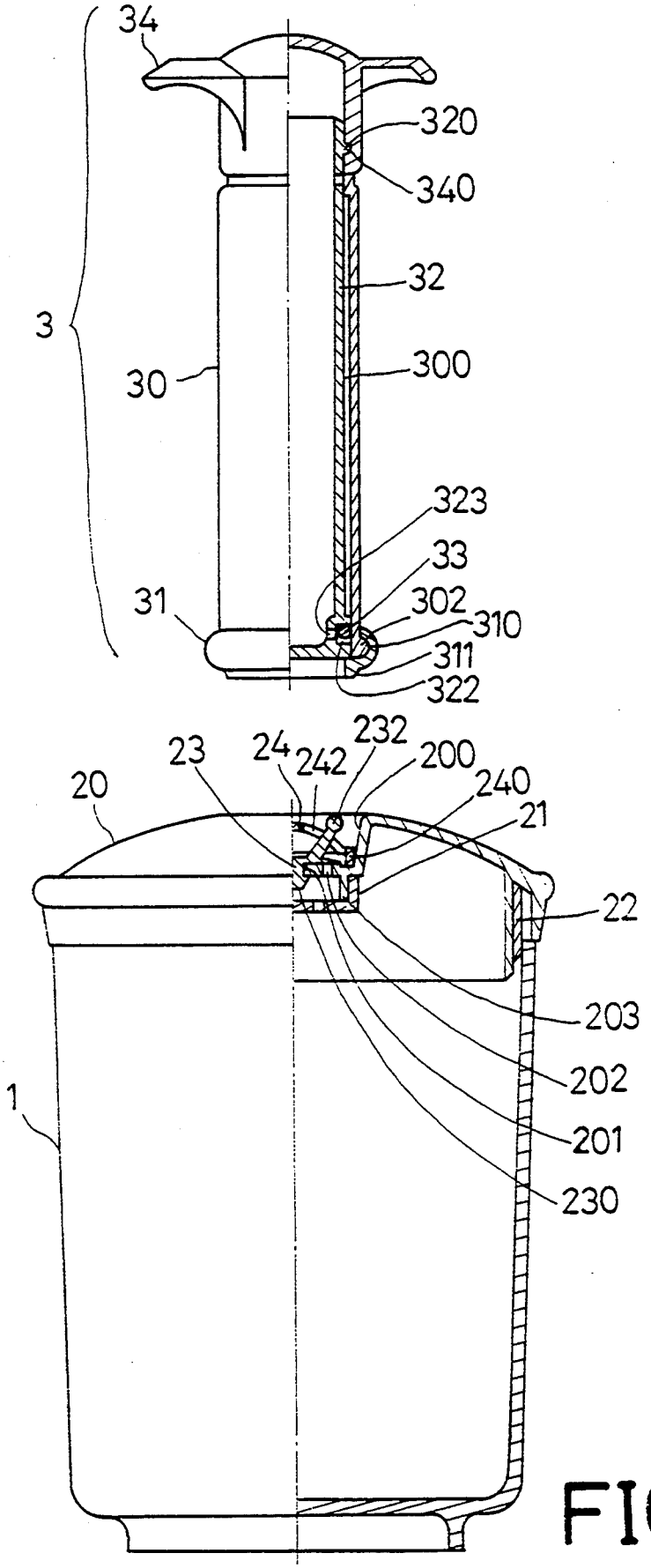
FIG. 4 is a half cross-sectional view of the sealed can possible to be pumped vacuum in the present invention.

In assembling, as shown in FIGS. 1, 3 and 4, first the small bottom cap 21 is made to fit around the projecting-down wall 203 of the sealing cap body 20, and next, the annular gasket 22 is inserted in the annular groove 207, and the downward projection 230 of the air valve 23 is forced to pass through the central hole 201 of the sealing cap body 20, with the air valve 23 closing the four air holes 202. After that the small upper cap 24 is covered on the air valve 23, with the two projections 231, 232 protruding up through the two slots 241 242. Then the small upper cap 24 is combined in the central recess 200 of the sealing cap body 20 by means of high frequency welding process. Then the cap unit 2 is finished in assembling.

Then, the vacuum pump 3 is to be assembled, by engaging the gasket 33 around the groove 322 of the pull cylinder 32, pushing the pull cylinder 32 in the passageway 300 of the cylinder 30 from under, engaging the annular socket 31 with the bottom of the cylinder 30, with the flange 302 fitting in the inner groove 310 of the socket 31, fitting the handle 34 around the top of the pull cylinder 32, with the inner groove 340 engaging the annular projection 320. Then the vacuum pump 3 is finished in assemblage.

Figure 5:
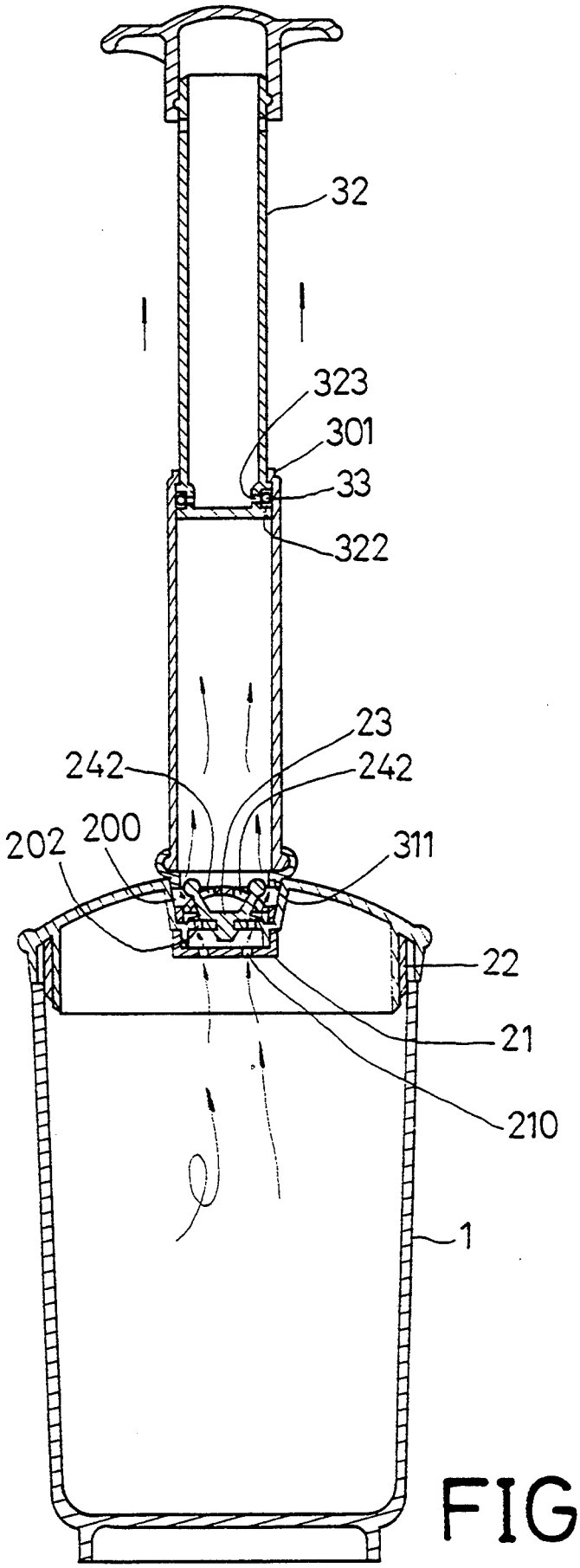
FIG. 5 is a cross-sectional view of the sealed can possible to be pumped vacuum and the vacuum pump in the present invention, showing air flow direction in pumping out air out the sealed can.
Figure 6:
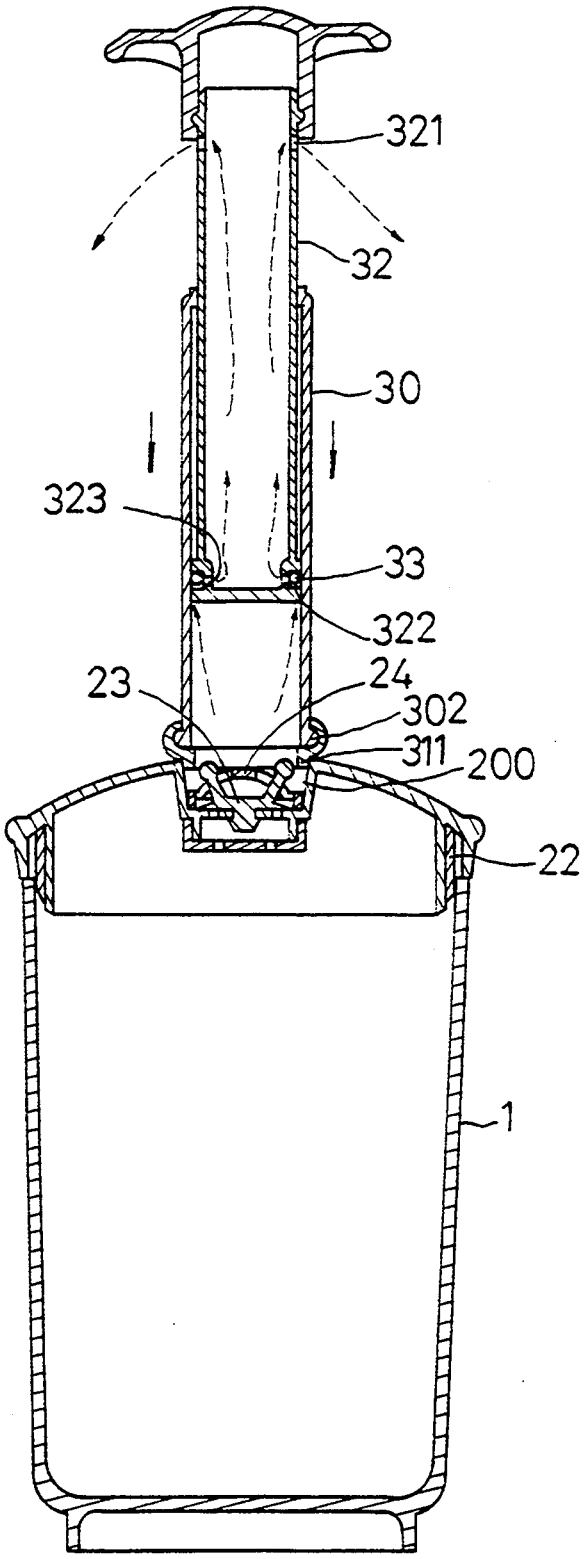
FIG. 6 is a cross-sectional view of the vacuum pump placed on the sealed can in the present invention, showing air flow direction when the pump is pressed down.

In using, food to be preserved is placed in the can body 1, and then the cap unit 2 is capped around the top of the can body 1. Next, as shown in FIG. 4, the engaging edge 311 of the annular socket 31 of the vacuum pump 3 is tightly placed on the central recess 200 of the sealing cap body 20. Then the pull cylinder 32 of the vacuum pump 3 is pulled up as shown in FIG. 5 to pump up the air in the cap body 1 out of the cap unit 2. The air in the can body 1 is drawn through the two air holes 210 of the small bottom cap 21, then through the four air holes 202, through the space between the air valve 23 and the central recess 200 of the sealing cap body 20 and through the two slots 241, 242 to flow into the cylinder 30. Meanwhile, the bottom of the pull cylinder 32 is stopped by the stop edge 301 of the cylinder 30, with the gasket 33 tightly fitting in the groove 322 and closely blocking the two air holes 323. When the pull cylinder 32 is pushed down to pump out the air in the body 1, as shown in FIG. 6, the gasket 33 is pushed upward, forcing the air in the cylinder 30 pumped out of the can body 1 flow through the gap between the cylinder 30 and the pull cylinder 32 and through the two air holes 323 into the pull cylinder 32 to be exhausted out of the air exit 321 in the pull cylinder 32. Thus, the air in the can body 1 is pumped out by the vacuum pump 3, becoming vacuum at last. The annular gasket 22 of the sealing cap body 20 is in tight contact around the top of the can body 1 because of atmospheric difference between the interior and the exterior of the can body 1, preventing open air from flowing into the can body. In addition, the four air holes 202 in the recess 200 of the sealing cap body 20 are tightly closed by the air valve 23, blocking open air from flowing through to keep the can body 1 in vacuum condition and preserving the food therein good and fresh for a long period of time.

Figure 7:
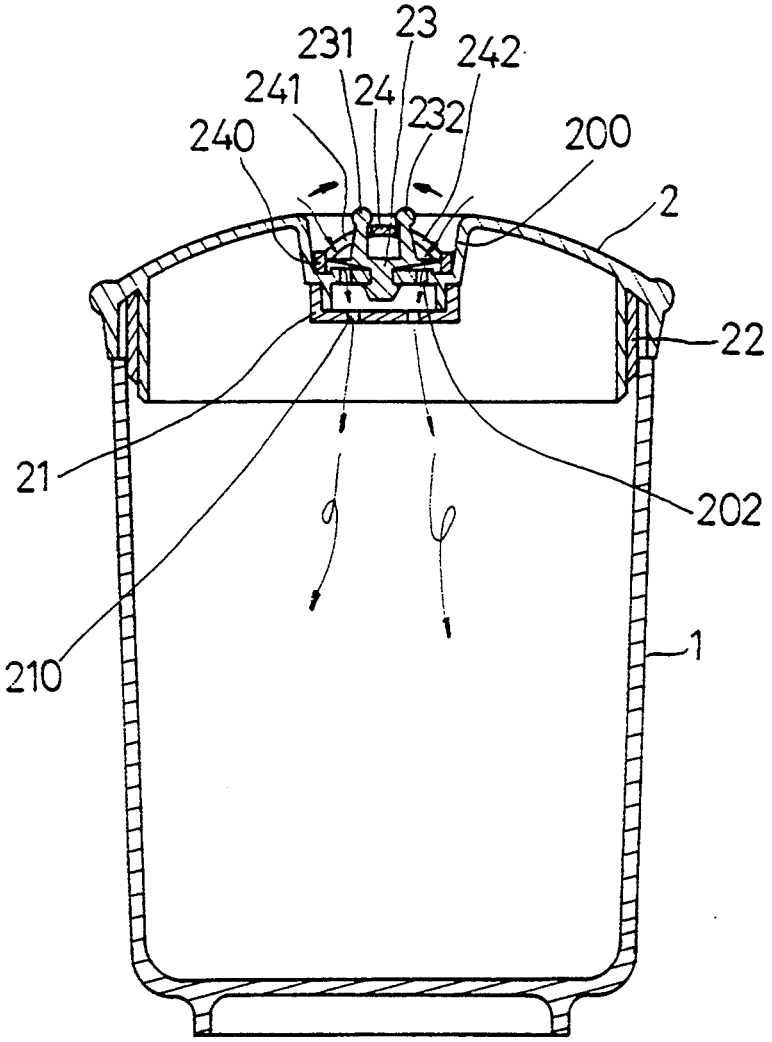
FIG. 7 is a cross-sectional view of the sealed can in the present invention, showing air entering into the can body when the air valve is pulled open.

If the food in the can body 1 is wanted to be taken out, as shown in FIG. 7, any of the two sloping projections 231, 231 of the air valve 23 protruding out of the two slots 241, 242 of the small upper cap 24 is moved inward, letting a gap formed between the air valve 23 and the recess 200 of the sealing cap body 20 so as to let open air flow through the two slots 241, 242, the four air holes 202 and the air holes 210 into the can body 1 until the atmosphere in the can body 1 becomes equal to that of open air. Then the cap unit 2 can be taken off the can body 1 and the food therein can be taken out.

What is claimed is:

1. A sealed vacuum container system comprising;

a) a cylindrically shaded can body;

b) a cap unit on said can body, and comprising;

i) a sealing cap body having a central upper recess, a central through hole in said upper recess, a plurality of air holes spaced around said central through hole, a first downwardly projecting annular wall engaging a bottom cap, a projecting outer circumferential curved edge, a second annular downwardly projecting wall extending from said curved edge, a third annular downwardly projecting wall, an annular groove formed between said second and third annular walls to accommodate an annular gasket therein;

ii) a bottom cap engaged with said first downwardly projecting annular wall, and having therein a plurality of air holes;

iii) an annular gasket located in said annular groove of said sealing cap body;

iv) an air valve provided in the recess of said sealing cap body, normally closing said plurality of air holes, and having a mushroom-shaped projection extending therefrom to pass through said central hole of said recess of said sealing cap body to thereby keep said air valve in place, and two sloping-up projections for opening said air valve; and, v) a small upper cap covering said air valve, having a circumferential sloping-down surface and two opposite slots to allow said two sloping-up projections to protrude therethrough; and, c) a vacuum pump for pumping air out of said can body, and comprising;

i) a stationary cylinder having a central passageway, a stop annular edge and a flange around a bottom having an annular groove inside the flange to engage an annular projection of a pull cylinder;

ii) a pull cylinder slidably fitting in said central passageway of said stationary cylinder, and having an annular projection on an upper portion, an air exit below said annular projection, an annular groove in a lower end portion, two opposite air holes in said annular groove, and an annular gasket engaging said annular groove; and, iii) a handle having a cylindrical portion with two lateral curved portions fixed firmly on a top of said pull cylinder above the stationary cylinder to pull said pull cylinder for pumping out the air in said can body; wherein said vacuum pump is placed on said cap unit and said pull cylinder is pulled up and down in said stationary cylinder to draw out the air from said can body, forming a vacuum so that internal and atmospheric pressure difference causes said air valve of the cap unit to tightly close said air holes such that food therein can be preserved for a long period of time.

* * * * *